United States Patent [19]

Wood

[11] 4,454,824

[45] Jun. 19, 1984

[54] BEACH LOCKER

[76] Inventor: Gary J. Wood, 13929 Hawick Dr., El Cajon, Calif. 92021

[21] Appl. No.: 349,332

[22] Filed: Feb. 16, 1982

Related U.S. Application Data

[63] Continuation-in-part of Ser. No. 180,610, Aug. 25, 1980.

[51] Int. Cl.[3] ..... E05G 1/00

[52] U.S. Cl. ..... 109/52; 109/50; 248/156; 248/552

[58] Field of Search ..... 109/1 R, 22, 23, 50, 109/52; 248/156, 545, 552

[56] References Cited

U.S. PATENT DOCUMENTS

| | | | |
|---|---|---|---|
| 1,571,295 | 2/1926 | Newman | 248/156 |
| 2,628,797 | 2/1953 | Campoman | 248/156 |
| 3,286,962 | 11/1966 | Warth | 248/156 |
| 3,709,401 | 1/1973 | Walstron | 109/52 |
| 3,710,736 | 1/1973 | Biondi | 109/52 |
| 3,743,289 | 7/1973 | Goloub | 248/156 |
| 4,072,286 | 2/1978 | Foncannon | 248/156 |

*Primary Examiner*—Gene Mancene
*Assistant Examiner*—John G. Weiss
*Attorney, Agent, or Firm*—Ralph S. Branscomb

[57] ABSTRACT

The invention is a device used by beach goers which by means of an auger at the end of a relatively long shaft the beach goer is able to engage the auger deep into the sand to firmly anchor a locker container in the sand. The auger drive mechanism is such that when a drive member is pulled up through the container top and engaged with a padlock to secure the container shut, the drive member disengages from the main shaft so that it is impossible to rotate the shaft by rotating the container because it free-wheels. Thus only by unlocking the padlock and releasing the drive member/lid retainer can the shaft be rotated to disengage it from the sand.

8 Claims, 8 Drawing Figures

FIG. 1
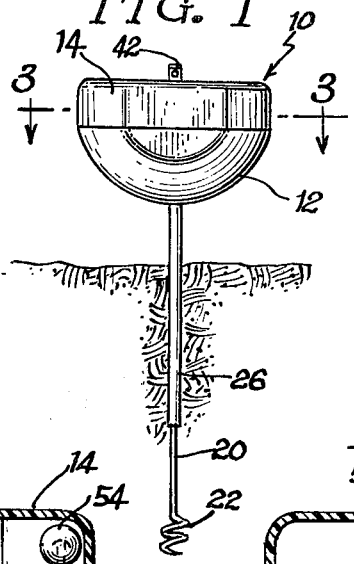
FIG. 2
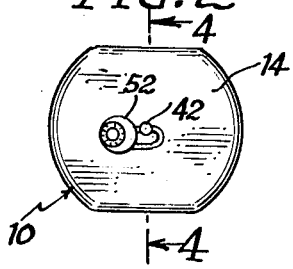
FIG. 3
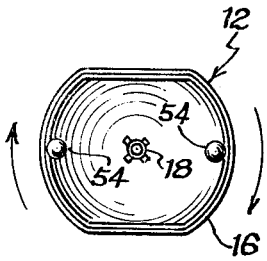
FIG. 4
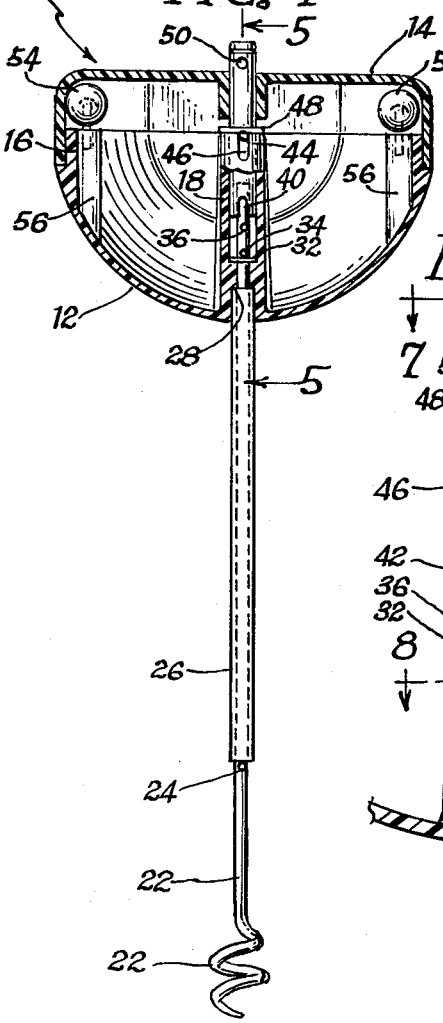
FIG. 5
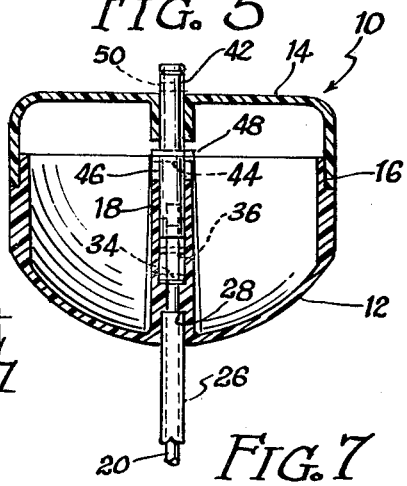
FIG. 6
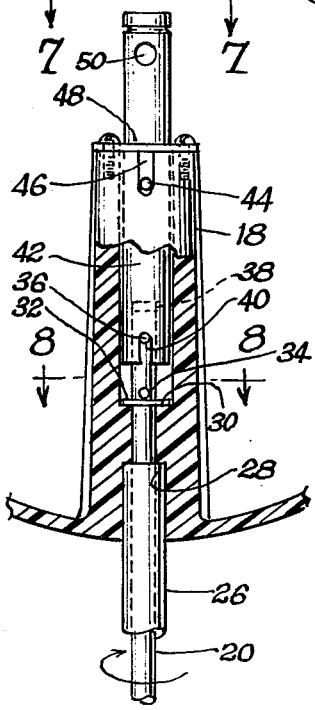
FIG. 7
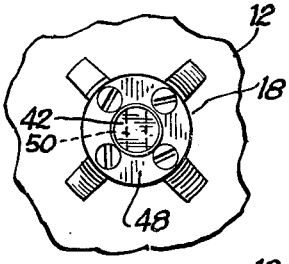
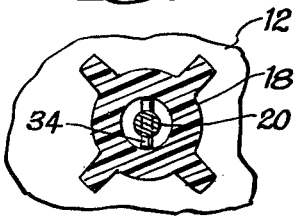
FIG. 8

BEACH LOCKER

BACKGROUND OF THE INVENTION

This application is a continuation-in-part of Application Ser. No. 180,610 for an invention also entitled a Beach Locker. That application discloses some of the basic principles utilized in the instant case, but the present application discloses more refined subject matter and a preferred means of implementing the invention.

The principal concept behind the invention is the provision of a locker or container for valuables at the beach. Not only is it necessary to provide a securable container, but also to anchor the container somehow in the sand. Although the crank mechanism disclosed in the parent application was effective, the entire mechanism has been vastly simplified in the instant case and has been shown to be economically feasible to produce.

The locker provides a heretofore unavailable security for ones personal possessions while at the beach. Although useful to anyone at a beach or other sandy location, the locker is of particular interest to surfers because of the long time that a surfer will spend in the water compared to the average bather.

Because in most beach situations the beach goers are principly strangers to one another, it is very easy for a thief to pick up personal possessions lying on a blanket or towel, as the surrounding people do not know that the thief is not the true owner. A real hardship is thus placed on beach goers and surfers because any valuables that they have taken to the beach ordinarily must be locked in a car, which may be far distant from the crowded beach.

SUMMARY OF THE INVENTION

The present invention, however, provides an extremely secure sand anchor coupled with a convenient locker so that surfers and bathers may securely enjoy themselves without constantly looking at the beach and worrying about whether their watches, wallets, car keys and other valuables are safe. The anchoring mechanism comprises an auger preferably formed directly into the end of a long stainless steel shaft. By rotation of the shaft the auger will engage deeper in the sand, or disengage, depending on the direction of rotation.

The basic principle of the locker lies in the inability of a potential thief to rotate the shaft by rotating the locker container after it had been locked. Although the locker will rotate, it free-wheels on the shaft and has no effect on the auger once it has been locked. Actual trials of the beach locker have demonstrated that it is impossible for a person who is not great in strength to engage the auger deep enough in the sand to lower the locker to the sand surface, with a resulting anchoring that is sufficiently strong to prevent removal of the locker even by the strongest of individuals.

The mechanism for alternately free-wheeling and engaging the shaft to the locker assembly includes a pin passed through an upper portion of the shaft and an engaging or locking member which fits over the shaft, having a slotted void which engages the shaft pin when in the lowered position but frees the shaft when raised. The locking member, although free to axially slide an inch or so within the locker container, is rotationally fixed to the locker.

When the lid is put on the locker and the drive member pulled up through the lid and secured with a padlock, it is impossible to engage the driving member onto the pin in the top of the shaft, and thus the locker free-wheels aimlessly on the shaft without accomplishing the disengagement of the auger if a thief attempts to remove the entire mechanism.

BRIEF DESCRIPTION OF THE DRAWINGS

FIG. 1 is an elevational view of the locker shown engaged in the sand;

FIG. 2 is a plan view of the top of the locker;

FIG. 3 is a plan view taken along Line 3—3 of FIG. 1 with the cover removed;

FIG. 4 is a sectional view taken along Line 4—4 of FIG. 2;

FIG. 5 is a sectional view taken along Line 5—5 of FIG. 4;

FIG. 6 is detail of the locking mechanism party cut away and partly sectioned;

FIG. 7 is a top plan view of the mechanism of FIG. 6 as seen along line 7—7 of that Figure;

FIG. 8 is a section taken along line 8—8 of FIG. 6.

DETAILED DESCRIPTION OF THE PREFERRED EMBODIMENT

The invention includes a hollow locker body 10 having a container 12 and a lid 14 which securely fits in a shoulder 16 defined in the container. The container has an elongated vertical boss 18 which is journaled on a shaft 20 having an auger 22 formed in the end.

At a position well down the shaft is a detent such as pin 24 which supports a sleeve 26 around the shaft, with the upper end of the sleeve being seated in a shoulder 28 in the boss 18 of the locker. Yet another shoulder 30 above shoulder 28 is used to capture the shaft in the container by virtue of retainer washer 32 and pin 34. Thus between the pins 24 and 34, the shoulders defined in the boss 18 and the sleeve 26, the shaft and the locker container are mutually secured against axial movement, although they are free to rotate.

Above the pin 34 is another pin 36 which selectably cooperates with a void 38 having a slot 40 defined in the bottom of drive member 42. The void fits over the top end of the shaft, with the slot 40 selectably engaging or freeing the pin 36. As can be seen in FIGS. 4 and 6, when the drive member 42 is raised to the position shown in FIG. 4, it is free of the shaft by virtue of the pin 36 and slot 40 being disengaged. The drive member can thus rotate with respect to the shaft.

The drive member is itself captive in the boss 18 of the locker container by virtue of retainer pin 44 which rides in slot 46 and is captured by the retainer cap 48. Thus the drive member 42 is permitted limited sliding freedom inside the boss of the container, but is never permitted to rotate relative to the locker container.

When the drive member is pulled to its upper position as shown in FIG. 4 it has an eyelet 50 which clears the lid 14 and can be engaged by a padlock such as indicated at 52. This padlock retains the lid 14 securely on the container 12, while simultaneously insuring that the drive member 42 is incapable of engaging the shaft 20 for rotation. An attempt to counter-rotate the locker container would simply result in its idling about the shaft. There is no exposed element which can be gripped for rotation when the padlock 52 is in place. The elongated sleeve 26 also rotates about the shaft, so that the first bare shaft portion available is more than a foot beneath the sand's surface.

To effectuate the engagement and disengagement of the auger 22, a pair of hand knobs 54 are rotatably mounted in bosses 56 molded in the interior of the container 12 of the locker. It has been demonstrated that a ten year old child is able to engage the beach locker fully down into the sand into the position shown in FIG. 1 by rotating the knobs 54. Even though a child can engage the locker, it is impossible for a full-grown adult to remove it as the engagement is so secure.

In addition to providing a storage container for small items of value, an anchor point is also provided for bicycle chains or cables which may be used to secure bicycles, possibly skateboards, surfboards and other large items much too big to be placed in any container. With the addition of this capability, virtually anything that could be taken to the beach is capable of being protected either by enclosure within the locker itself or by passing a chain or cable through some part of the item, making the beach locker universal in its application.

What is claimed is:

1. A completely self-contained and portable beach locker defining a lockable compartment capable of locked engagement in beach sand to secure valuables without requiring external mountings or equipment, comprising:

(a) a shaft having an upper and a lower end, and having an auger on said lower end for spiralling into or out of the sand;

(b) means for rotating the upper end of said shaft to permit a user to apply torque to said shaft;

(c) a lockable container mounted on said upper end of said shaft;

(d) a selective disenabler for said means for rotating such that said means for rotating is rendered ineffective when said disenabler is operative, such that in operation, said shaft can be rotated to engage said auger deep into said sand prior to engaging said disenabler and said disenabler can then be engaged to prevent counter-rotation and removal of said shaft, and said disenabler being substantially enclosed within said containers such that when said disenabler is operative and said container locked, said disenabler cannot be disengaged until said container is unlocked.

2. Structure according to claim 1 wherein said means for rotating includes a torquing member mounted to the upper portion of said shaft and said selective disenabler comprises means for alternatively locking and unlocking said shaft and torquing member together mutually non-rotationally to permit rotation of said auger by rotation of said torquing member, and disengaging said shaft and torquing member to permit free-wheeling therebetween.

3. Structure according to claim 2 wherein said means for alternatively locking and unlocking said shaft comprises an elongated slotted drive member having an axis and being non-rotational with respect to said torquing member about said axis, and a cooperating pin through said shaft, such that raising said drive member frees the slot therein from said pin and lowering said drive member non-rotationally engages said pin in said slot.

4. Structure according to claim 3 wherein said torquing member and lockable container are unitary.

5. Structure according to claim 4 wherein said container has a lid, said drive member is axially slidable in said container and passes up through said lid and has an eyelet engagable by a padlock to retain said drive member up clear of said pin such that said locker container free-wheels on said shaft.

6. Structure according to claim 4 and including at least one manual turning knob disposed within said container for rotating same around said shaft.

7. Structure according to claim 1 wherein said selective disenabler comprises an axially adjustable drive member co-axial with said shaft and having a slotted void in the bottom fitting over the upper end of said shaft, said shaft has a pin selectably disengageable by the slot of said slotted void, and said shaft includes means axially anchoring same in said locker container.

8. Structure according to claim 7 wherein said means axially anchoring said shaft includes a sleeve around said shaft captured by a retainer toward the bottom of said shaft and a shoulder in said container which seats the top of said sleeve, such that said sleeve is rotationally independent of said shaft to prevent rotating said shaft by gripping it immediately below said container.

* * * * *